US011274262B2

(12) United States Patent
Sunahara et al.

(10) Patent No.: US 11,274,262 B2
(45) Date of Patent: Mar. 15, 2022

(54) LUBRICATING OIL COMPOSITION AND USE METHOD THEREFOR

(71) Applicants: IDEMITSU KOSAN CO., LTD., Chiyoda-ku (JP); TOYOTA JIDOSHA KABUSHIKI KAISHA, Toyota (JP)

(72) Inventors: Kenji Sunahara, Tsukuba (JP); Kazuo Yamamori, Nagoya (JP); Kosuke Fujimoto, Nisshin (JP)

(73) Assignees: IDEMITSU KOSAN CO., LTD., Chiyoda-ku (JP); TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/042,654

(22) PCT Filed: Mar. 26, 2019

(86) PCT No.: PCT/JP2019/012768
§ 371 (c)(1),
(2) Date: Sep. 28, 2020

(87) PCT Pub. No.: WO2019/189121
PCT Pub. Date: Oct. 3, 2019

(65) Prior Publication Data

US 2021/0032559 A1 Feb. 4, 2021

(30) Foreign Application Priority Data

Mar. 30, 2018 (JP) ..... JP2018-069855

(51) Int. Cl.

| | |
|---|---|
| ***C10M 145/14*** | (2006.01) |
| ***C10M 101/02*** | (2006.01) |
| ***C10M 107/02*** | (2006.01) |
| ***C10M 169/04*** | (2006.01) |
| *C10N 20/00* | (2006.01) |
| *C10N 40/25* | (2006.01) |
| *C10N 20/02* | (2006.01) |
| *C10N 30/02* | (2006.01) |
| *C10N 30/04* | (2006.01) |
| *C10N 30/06* | (2006.01) |

(52) U.S. Cl.
CPC ..... *C10M 145/14* (2013.01); *C10M 101/02* (2013.01); *C10M 107/02* (2013.01); *C10M 169/048* (2013.01); *C10M 2203/1006* (2013.01); *C10M 2205/003* (2013.01); *C10M 2209/084* (2013.01); *C10N 2020/02* (2013.01); *C10N 2020/071* (2020.05); *C10N 2020/073* (2020.05); *C10N 2030/02* (2013.01); *C10N 2030/04* (2013.01); *C10N 2030/06* (2013.01); *C10N 2040/252* (2020.05)

(58) Field of Classification Search
CPC C10M 145/14; C10M 101/02; C10M 107/02; C10M 169/048; C10M 2203/1006; C10M 2205/003; C10M 2209/084; C10N 2020/071; C10N 2020/073; C10N 2040/252; C10N 2020/02; C10N 2030/02; C10N 2030/04; C10N 2030/06
See application file for complete search history.

(56) References Cited

U.S. PATENT DOCUMENTS

| | | | | |
|---|---|---|---|---|
| 2008/0085847 | A1* | 4/2008 | Tse | C10M 143/08 508/591 |
| 2013/0237465 | A1 | 9/2013 | Andoh et al. | |
| 2013/0317166 | A1 | 11/2013 | Kanamaru et al. | |
| 2015/0175927 | A1* | 6/2015 | Utaka | C10M 167/00 508/364 |
| 2016/0002563 | A1* | 1/2016 | Kasai | C10M 161/00 508/192 |
| 2016/0348027 | A1* | 12/2016 | Utaka | C10M 167/00 |
| 2017/0137732 | A1* | 5/2017 | Utaka | C10L 1/1641 |
| 2017/0349855 | A1 | 12/2017 | Ueda et al. | |
| 2018/0100112 | A1* | 4/2018 | Honda | C10M 107/02 |

(Continued)

FOREIGN PATENT DOCUMENTS

| | | |
|---|---|---|
| CN | 101851548 A | 10/2010 |
| CN | 101851549 A | 10/2010 |

(Continued)

OTHER PUBLICATIONS

Indian Office Action dated Jan. 18, 2021 in Indian Patent Application No. 202047043570 (with English translation), 5 pages.

(Continued)

*Primary Examiner* — Ellen M McAvoy
(74) *Attorney, Agent, or Firm* — Oblon, McClelland, Maier & Neustadt, L.L.P.

(57) ABSTRACT

Provided are a lubricating oil composition used in a diesel engine equipped with a forced-induction compressor, containing a base oil (A) containing a poly-α-olefin (A1), and a viscosity index improver (B) having an SSI (shear stability index) of 20 or less, having a distillation amount of a light fraction of 496° C. or less in a gas chromatography distillation test of less than 80% by volume, having a high retention of the effect of suppressing the formation of deposits that may occur inside the compressor, and being capable of retaining a high efficiency of the compressor for a long period of time, in the use thereof in a diesel engine equipped with a forced-induction compressor having an outlet temperature of the compressor becoming a high temperature reaching 190° C. or more, and a method for using the lubricating oil composition.

20 Claims, No Drawings

(56) References Cited

U.S. PATENT DOCUMENTS

| | | | | |
|---|---|---|---|---|
| 2019/0024009 | A1* | 1/2019 | Kusumoto | C10M 137/10 |
| 2020/0263106 | A1* | 8/2020 | Ueda | C10M 109/00 |
| 2020/0339903 | A1* | 10/2020 | Oki | C10M 107/10 |

FOREIGN PATENT DOCUMENTS

| | | | |
|---|---|---|---|
| CN | 104531289 | A | 4/2015 |
| CN | 106190505 | A | 12/2016 |
| CN | 106459821 | A | 2/2017 |
| EP | 3 282 002 | A1 | 2/2018 |
| JP | 2008-120908 | A | 5/2008 |
| JP | 2013-185087 | A | 9/2013 |
| JP | 2015-25079 | A | 2/2015 |
| JP | 2015-160951 | A | 9/2015 |
| JP | 2016-113497 | A | 6/2016 |
| JP | 2016-196595 | A | 11/2016 |
| JP | 2017-119787 | A | 7/2017 |
| JP | 2017-149830 | A | 8/2017 |
| WO | WO 2012/070240 | A1 | 5/2012 |
| WO | WO 2017/114836 | A1 | 7/2017 |

OTHER PUBLICATIONS

Japanese Office Action dated Mar. 24, 2020 in Japanese Application 2018-069855 (with English Translation), 8 pages.

Extended European Search Report dated Apr. 7, 2021 in European Patent Application No. 19777650.3, citing documents AO and AP therein, 8 pages.

International Search Report dated Jun. 25, 2019 in PCT/JP2019/012768 filed Mar. 26, 2019, citing documents AA-AE and AN-AV therein, 2 pages.

Indian Office Action dated Aug. 9, 2021 in Indian Patent Application No. 202047043570, 2 pages.

Office Action dated Dec. 31, 2021, in Chinese Patent Application No. 201980023659.X filed Mar. 26, 2019.

* cited by examiner

LUBRICATING OIL COMPOSITION AND USE METHOD THEREFOR

TECHNICAL FIELD

The present invention relates to a lubricating oil composition and a method for using the lubricating oil composition.

BACKGROUND ART

In recent years, internal-combustion engines are being demanded to address various issues including the fuel consumption regulation, the waste gas regulation, and the like, and the improvement of forced-induction compressors for addressing the demands has been widely performed.

For example, for addressing the waste gas regulation, development is being performed for a forced-induction compressor equipped with an EGR (exhaust gas recirculation) system in which a part of an exhaust gas is again breathed and circulated.

In the forced-induction compressor equipped with the EGR system, the increase of the boost pressure increases the outlet temperature of the compressor, and deposits derived from the engine oil tend to build up inside the compressor.

The presence of the deposits formed inside the compressor may problematically be a factor decreasing the efficiency of the forced-induction compressor.

Under the circumstances, various investigations have been made for an engine oil capable of suppressing the formation of deposits inside the compressor of the forced-induction system.

For example, PTL 1 describes, for providing a lubricating oil composition having an enhanced capability of suppressing the deposits that may build up inside the compressor, a lubricating oil composition containing a fraction having a boiling point of 500 to 550° C. in an amount of 14% by mass or more and a fraction having a boiling point exceeding 550° C. in an amount of 5% by mass or more.

CITATION LIST

Patent Literature

PTL 1: JP 2016-196595 A

SUMMARY OF INVENTION

Technical Problem

A forced-induction compressor mounted on a diesel engine has a higher boost pressure than an ordinary engine, and the outlet temperature of the compressor may become a high temperature of 190° C. or more in some cases, which may be a favorable environment for deposits to build up inside the compressor.

It has been found by the investigations by the present inventors that in the case where an ordinary engine oil is used under the environment, the effect of suppressing the deposit formation is retained in the use for a relatively short period of time, but the effect of suppressing the deposit formation is decreased with the lapse of the use time, and a large amount of deposits are formed inside the compressor. In particular, the decrease of the effect of suppressing the deposit formation may occur suddenly in some cases, which may be a factor causing a sudden failure of the engine.

Therefore, the sudden decrease of the efficiency of the compressor may be a problem.

The lubricating oil composition described in PTL 1 assumes the use thereof in a diesel engine, but there is no investigation from the standpoint of the retention of the effect of suppressing the deposit formation in the use for a long period of time under the environment with the outlet temperature of the compressor becoming a high temperature reaching 190° C. or more.

An object of the present invention is to provide a lubricating oil composition that has a high retention of the effect of suppressing the formation of deposits that may occur inside the compressor and is capable of retaining a high efficiency of the compressor for a long period of time, in the use thereof in a diesel engine equipped with a forced-induction compressor having an outlet temperature of the compressor becoming a high temperature reaching 190° C. or more, and a method for using the lubricating oil composition.

Solution to Problem

The present inventors have found that the problem can be solved by a lubricating oil composition that contains a viscosity index improver having an SSI (shear stability index) within a prescribed range along with a base oil containing a poly-α-olefin, and has a distillation amount of a light fraction within a prescribed range, and thus the present invention has been completed.

The present invention provides the following items [1] to [12].

[1] A lubricating oil composition used in a diesel engine equipped with a forced-induction compressor, containing a base oil (A) containing a poly-α-olefin (A1), and a viscosity index improver (B) having an SSI (shear stability index) of 20 or less, and having a distillation amount of a light fraction of 496° C. or less in a gas chromatography distillation test of less than 80% by volume.

[2] The lubricating oil composition according to the item [1], wherein the viscosity index improver (B) contains at least one of a star polymer (B1) and a comb polymer (B2).

[3] The lubricating oil composition according to the item [2], wherein the lubricating oil composition has contents of the star polymer (B1) and the comb polymer (B2) in terms of resin component each independently of 0.01 to 10% by mass based on the total amount of the lubricating oil composition.

[4] The lubricating oil composition according to the item [2] or [3], wherein the viscosity index improver (B) contains a star polymer (B1) and a polymethacrylate (B3).

[5] The lubricating oil composition according to the item [4], wherein the lubricating oil composition has a content of the polymethacrylate (B3) in terms of resin component of 0.01 to 10% by mass based on the total amount of the lubricating oil composition.

[6] The lubricating oil composition according to the item [4] or [5], wherein the lubricating oil composition has a content ratio ((B1)/(B3)) in terms of resin component of the star polymer (B1) and the polymethacrylate (B3) in terms of mass ratio of 0.07 to 0.20.

[7] The lubricating oil composition according to any one of the items [1] to [6], wherein the poly-α-olefin (A1) has a kinematic viscosity at 100° C. of 5.0 $mm^2/s$ or more.

[8] The lubricating oil composition according to any one of the items [1] to [7], wherein the base oil (A) further contains a mineral oil (A2).

[9] The lubricating oil composition according to any one of the items [1] to [8], wherein the lubricating oil composition has a content of the poly-α-olefin (A1) of 30% by mass or more based on the total amount of the base oil (A).

[10] The lubricating oil composition according to any one of the items [1] to [9], wherein the lubricating oil composition has a kinematic viscosity at 100° C. of 5.6 to 12.5 $mm^2/s$.

[11] The lubricating oil composition according to any one of the items [1] to [10], wherein the lubricating oil composition has a HTHS viscosity at 100° C. of 4.0 to 6.3 mPa·s.

[12] A method for using a lubricating oil composition, including using the lubricating oil composition according to any one of the items [1] to [11] in a diesel engine equipped with a forced-induction compressor having an outlet temperature of a compressor becoming 190° C. or more.

Advantageous Effects of Invention

The lubricating oil composition of the present invention has a high retention of the effect of suppressing the formation of deposits that may occur inside the compressor and is capable of retaining a high efficiency of the compressor for a long period of time, in the use thereof in a diesel engine equipped with a forced-induction compressor having an outlet temperature of the compressor becoming a high temperature reaching 190° C. or more.

DESCRIPTION OF EMBODIMENTS

[Lubricating Oil Composition]

The lubricating oil composition of the present invention is used in a diesel engine equipped with a forced-induction compressor, contains a base oil (A) containing a poly-α-olefin (A1) and a viscosity index improver (B) having an SSI (shear stability index) of 20 or less, and is prepared to satisfy the following requirement (I).

Requirement (I): The distillation amount of a light fraction of 496° C. or less in a gas chromatography distillation test in the lubricating oil composition is less than 80% by volume.

The present inventors have earnestly investigated about a lubricating oil composition that is capable of enhancing the retention of the effect of suppressing the formation of deposits that may occur inside the compressor, in the use thereof in a diesel engine equipped with a forced-induction compressor having an outlet temperature of the compressor becoming 190° C. or more.

As a result, it has been found firstly that the retention of the effect of suppressing the deposit formation can be enhanced by blending a viscosity index improver (B) prepared to have an SSI of 20 or less with a base oil (A) containing a poly-α-olefin (A1).

Simultaneously, it has also been found that a lubricating oil composition that has a distillation amount of a light fraction of 496° C. or less exceeding 80% by volume is under an environment where deposits are readily formed in a compressor becoming 190° C. or more, and the retention of the effect of suppressing the deposit formation is lowered.

The phenomenon is considered to be caused by the mechanism that in a compressor at a high temperature, the light fraction vaporizes to concentrate the substances becoming the factors of deposits, such as soot, in the oil, which are readily attached to the surface of the members inside the compressor, and as a result, deposits are readily formed.

Accordingly, the lubricating oil composition of the present invention is prepared to have a distillation amount of a light fraction of 496° C. or less of less than 80% by volume, as defined by the requirement (I).

From this standpoint, the distillation amount of a light fraction of 496° C. or less defined by the requirement (I) is preferably 78% by volume or less, more preferably 75% by volume or less, further preferably 72% by volume or less, and still further preferably 70% by volume or less.

The distillation amount of a light fraction of 496° C. or less defined by the requirement (I) is preferably 30% by volume or more, more preferably 40% by volume or more, further preferably 50% by volume or more, and still further preferably 55% by volume or more.

In the description herein, the "gas chromatography distillation test" defined in the requirement (I) means the test method according to ASTM D6352.

The lubricating oil composition that satisfies the requirement (I) can be prepared by appropriately setting the kind, the kinematic viscosity, and the content of the base oil (A). The more specific method for preparing the lubricating oil composition that satisfies the requirement (I) will be described later.

The lubricating oil composition of the present invention contains the components (A) and (B) and is prepared to satisfy the requirement (I), and therefore exhibits the significant effect, i.e., the retention of the effect of suppressing the formation of deposits that may occur inside the compressor can be enhanced even in the use thereof in a diesel engine equipped with a forced-induction compressor having an outlet temperature of the compressor becoming 190° C. or more.

The lubricating oil composition of the present invention contains the base oil (A) containing the poly-α-olefin (A1) and the viscosity index improver (B) having an SSI (shear stability index) of 20 or less, and may further contain additives for a lubricating oil composition.

In one embodiment of the lubricating oil composition of the present invention, the total content of the components (A) and (B) is preferably 60% by mass or more, more preferably 70% by mass or more, further preferably 75% by mass or more, and still further preferably 80% by mass or more, based on the total amount (100% by mass) of the lubricating oil composition.

The components contained in the lubricating oil composition of one embodiment of the present invention will be described below.

<Base Oil (A)>

The base oil (A) contained in the lubricating oil composition of the present invention contains at least a poly-α-olefin (A1), and may further contain a mineral oil (A2), and may further contain a synthetic oil (A3) other than the component (A1).

The base oil (A) used in one embodiment of the present invention may be used alone or as a combination of two or more kinds thereof.

In the lubricating oil composition of one embodiment of the present invention, the content of the base oil (A) is generally 55% by mass or more, preferably 60% by mass or more, more preferably 65% by mass or more, further preferably 70% by mass or more, and still further preferably 75% by mass or more, and is preferably 99.9% by mass or less, more preferably 98% by mass or less, and further preferably 95% by mass or less, based on the total amount (100% by mass) of the lubricating oil composition.

[Poly-α-olefin (A1)]

In the lubricating oil composition of the present invention, the base oil (A) contains the poly-α-olefin (A1), so as to enhance the retention of the effect of suppressing the formation of deposits that may occur inside the compressor, and to facilitate the preparation of the lubricating oil composition that satisfies the requirement (I).

The base oil (A) may be consisting only of the poly-α-olefin (A1).

In one embodiment of the present invention, the content of the poly-α-olefin (A1) in the base oil (A) is preferably 30% by mass or more, more preferably 35% by mass or more, further preferably 40% by mass or more, and still further preferably 50% by mass or more, based on the total amount (100% by mass) of the base oil (A), from the standpoint of the enhancement of the retention of the effect of suppressing the formation of deposits that may occur inside the compressor, and the achievement of the lubricating oil composition satisfying the requirement (I).

The poly-α-olefin (A1) used in one embodiment of the present invention may be, for example, a homopolymer of an α-olefin or may be an α-olefin copolymer.

More specific examples of the poly-α-olefin (A1) include a polymer obtained through polymerization of 1-decene and a hydrogenated product thereof, and a copolymer of ethylene and an α-olefin having 8 to 20 (preferably 8 to 14) carbon atoms.

The poly-α-olefin (A1) may be used alone or as a combination of two or more kinds thereof.

[0026]

The kinematic viscosity at 100° C. of the poly-α-olefin (A1) used in one embodiment of the present invention is preferably 5.0 $mm^2/s$ or more, more preferably 5.2 $mm^2/s$ or more, and further preferably 5.4 $mm^2/s$ or more, from the standpoint of the preparation of the lubricating oil composition satisfying the requirement (I), and is preferably 11.0 $mm^2/s$ or less, more preferably 10.0 $mm^2/s$ or less, and further preferably 9.0 $mm^2/s$ or less, from the standpoint of the enhancement of the fuel efficiency capability.

The viscosity index of the poly-a-olefin (A1) is preferably 115 or more, more preferably 120 or more, and further preferably 130 or more.

In the case where the poly-α-olefin (A1) is a mixture of two or more kinds, it suffices that the kinematic viscosity and the viscosity index of the mixture are in the aforementioned ranges.

[Mineral Oil (A2)]

The base oil (A) used in one embodiment of the present invention preferably contains a mineral oil (A2) in addition to the poly-α-olefin (A1).

The mineral oil (A2) contained can improve the compatibility with various additives, and as a result, a lubricating oil composition that conforms to the regulations as an engine oil can be readily prepared while enhancing the retention of the effect of suppressing the deposit formation.

From this standpoint, the content of the mineral oil (A2) in the base oil (A) is preferably 5 to 70% by mass, more preferably 10 to 65% by mass, and further preferably 15 to 60% by mass, based on the total amount (100% by mass) of the base oil (A).

From the same standpoint, the content ratio ((A1)/(A2)) of the poly-α-olefin (A1) and the mineral oil (A2) in terms of mass ratio is preferably 30/70 to 95/5, more preferably 35/65 to 90/10, further preferably 40/60 to 85/15, and still further preferably 42/58 to 82/18.

Examples of the mineral oil (A2) include an atmospheric residue oil obtained through atmospheric distillation of a crude oil, such as a paraffin base crude oil, an intermediate base crude oil, and a naphthene base crude oil; a distillate oil or wax obtained through distillation under reduced pressure of the atmospheric residue oil; a mineral oil obtained through at least one of refining treatments, such as a solvent deasphalting treatment, a solvent extraction treatment, a solvent dewaxing treatment, a catalytic dewaxing treatment, a hydrogenation isomerization treatment, and a hydrogenation decomposition treatment, of the distillate oil or wax; and a mineral oil (GTL, gas to liquids) obtained through isomerization of GTL wax obtained through the Fischer-Tropsch process using natural gas as a raw material.

The mineral oil (A2) may be used alone or as a combination of two or more kinds thereof.

The mineral oil (A2) used in one embodiment of the present invention is preferably a mineral oil obtained through at least one refining treatment selected from a solvent deasphalting treatment, a solvent extraction treatment, a solvent dewaxing treatment, a catalytic dewaxing treatment, a hydrogenation isomerization treatment, and a hydrogenation decomposition treatment, or a mineral oil obtained through isomerization of GTL wax.

The mineral oil (A2) is more preferably a mineral oil classified into Group 2 of the base oil category according to API (American Petroleum Institute) or a mineral oil classified into Group 3 thereof (including a mineral oil obtained through isomerization of GTL wax), and further preferably a mineral oil classified into Group 3 thereof (including a mineral oil obtained through isomerization of GTL wax).

[0032]

The kinematic viscosity at 100° C. of the mineral oil (A2) used in one embodiment of the present invention is preferably 2.5 to 11.0 $mm^2/s$, more preferably 2.8 to 10.0 $mm^2/s$, and further preferably 3.0 to 9.0 $mm^2/s$, from the standpoint of the achievement of the lubricating oil composition that satisfies the requirement (I) and is excellent in fuel efficiency capability.

The viscosity index of the mineral oil (A2) is preferably 110 or more, more preferably 120 or more, and further preferably 130 or more.

In the case where the mineral oil (A2) is a mixture of two or more kinds, it suffices that the kinematic viscosity and the viscosity index of the mixture are in the aforementioned ranges.

[Synthetic Oil (A3) Other than Component (A1)]

The base oil (A) used in one embodiment of the present invention may contain a synthetic oil (A3) other than the poly-α-olefin (A1).

The content of the synthetic oil (A3) in the base oil (A) is preferably 0 to 30% by mass, more preferably 10 to 20% by mass, and further preferably 0 to 10% by mass, based on the total amount (100% by mass) of the base oil (A).

In the base oil (A) used in one embodiment of the present invention, the content of the synthetic oil (A3) is preferably 0 to 25 parts by mass, more preferably 0 to 20 parts by mass, further preferably 0 to 15 parts by mass, and still further preferably 0 to 10 parts by mass, per 100 parts by mass in total of the poly-α-olefin (A1).

Examples of the synthetic oil (A3) include an ester-based synthetic oil, such as a polyol ester and a dibasic acid ester; an ether-based synthetic oil, such as a polyphenyl ether; a polyalkylene glycol; an alkylbenzene; and an alkylnaphthalene.

The synthetic oil (A3) may be used alone or as a combination of two or more kinds thereof.

Among these, the synthetic oil (A3) used in one embodiment of the present invention is preferably an ester-based synthetic oil.

[0036]

The kinematic viscosity at 100° C. of the synthetic oil (A3) used in one embodiment of the present invention is preferably 2.5 to 11.0 $mm^2/s$, more preferably 2.8 to 10.0 $mm^2/s$, and further preferably 3.0 to 9.0 $mm^2/s$, from the standpoint of the achievement of the lubricating oil composition that satisfies the requirement (I) and is excellent in fuel efficiency capability.

The viscosity index of the synthetic oil (A3) is preferably 100 or more, more preferably 110 or more, and further preferably 120 or more.

<Viscosity Index Improver (B)>

The lubricating oil composition of the present invention contains a viscosity index improver (B) having an SSI (shear stability index) of 20 or less.

The viscosity index improver (B) may be formed only of a viscosity index improver having an SSI of 20 or less.

In the lubricating oil composition of one embodiment of the present invention, the content of the viscosity index improver (B) in terms of resin component is preferably 0.01 to 20% by mass, more preferably 0.05 to 15% by mass, further preferably 0.10 to 10% by mass, and still further preferably 0.20 to 5% by mass, based on the total amount (100% by mass) of the lubricating oil composition.

A viscosity index improver is commercially distributed in the form of a solution dissolved in a diluent oil, such as a mineral oil, a synthetic oil, or a light oil, in consideration of the handleability and the solubility in a base oil, and in the preparation of the lubricating oil composition, the viscosity index improver may be blended in the form of a solution containing a diluent oil in some cases.

In the description herein, however, the content of the viscosity index improver is the "content in terms of resin component" as described above, and thus means the content of the resin component excluding the diluent oil. This is similarly applied to the contents of components (B1) to (B3) and the like as specific embodiments of the viscosity index improver (B).

The value of SSI of the viscosity index improver herein is a physical property value in terms of percentage that shows the decrease in viscosity due to shear derived from the polymer constituting the viscosity index improver. In other words, the value of SSI shows the resisting capability against shear of the polymer, and a larger value of SSI can be said that the polymer is unstable to the shear and is more readily decomposed.

The viscosity index improver (B) prepared to have an SSI of 20 or less is constituted by a polymer that is stable to shear, and therefore the polymer chain is hard to decompose even in long-term use, and it is likely to suppress the formation of broken short polymer chains, which may be a factor of the deposit formation. Consequently, the lubricating oil composition can have the further enhanced retention of the effect of suppressing the formation of deposits that may occur inside the compressor.

From this standpoint, the SSI of the viscosity index improver (B) is preferably 19.5 or less, more preferably 19.0 or less, and further preferably 18.7 or less, and is generally 0.1 or more, and preferably 0.2 or more.

In the present invention, in the case where the viscosity index improver (B) is a mixture of two or more kinds, the SSI of the viscosity index improver (B) is the SSI of the mixture.

Specifically, in the case where two or more kinds of viscosity index improvers different in SSI from each other are used, it suffices that the SSI of the mixture of the viscosity index improvers is in the aforementioned range.

In the description herein, the SSI of the viscosity index improver (B) means a value that is measured according to ASTM D6278, and more specifically is a value that is calculated by the following calculation expression (1).

$$SSI = \frac{Kv_0 - Kv_1}{Kv_0 - Kv_{oil}} \times 100 \quad (1)$$

In the expression (1), $Kv_0$ represents the value of kinematic viscosity at 100° C. of a specimen oil obtained by diluting the target viscosity index improver (B) with a mineral oil, $Kv_1$ represents the value of kinematic viscosity at 100° C. of a specimen oil obtained by diluting the viscosity index improver (B) with a mineral oil, after passing through a high-shear Bosch diesel injector in 30 cycles according to the method of ASTM D6278, and $Kv_{oil}$ represents the value of kinematic viscosity at 100° C. of the mineral oil used for diluting the viscosity index improver (B).

The value of SSI of the viscosity index improver (B) may vary depending on the structure of the polymer constituting the viscosity index improver (B), and specifically has the following tendencies.

With a larger proportion of a branched polymer than that of a linear polymer, the value of SSI is lowered.

With a larger molecular weight of the side chain of the branched polymer, the value of SSI is lowered.

With a larger proportion of a star polymer or a comb polymer than that of a linear polymer, the value of SSI is lowered.

In one embodiment of the present invention, the viscosity index improver (B) preferably contains at least one of a star polymer (B1) and a comb polymer (B2).

At least one of the star polymer (B1) and the comb polymer (B2) contained can easily control the SSI of the viscosity index improver (B) to 20 or less.

The viscosity index improver (B) may be formed only of the star polymer (B1).

In one embodiment of the present invention, the total content of the star polymer (B1) and the comb polymer (B2) in terms of resin component in the viscosity index improver (B) is preferably 3.0% by mass or more, more preferably 5.0% by mass or more, and further preferably 8.0% by mass or more, based on the total amount of resin component (100% by mass) of the viscosity index improver (B).

[Star Polymer (B1)]

It suffices that the star polymer (B1) is a polymer that has a structure having three or more linear polymer chains bonded at one point.

Examples of the linear polymer chain constituting the star polymer (B1) include a copolymer of a vinyl aromatic monomer and a conjugated diene monomer, and a hydrogenated product thereof.

Examples of the vinyl aromatic monomer include styrene, styrene substituted by an alkyl group having 8 to 16 carbon atoms, styrene substituted by an alkoxy group having 8 to 16 carbon atoms, vinylnaphthalene, and vinylnaphthalene substituted by an alkyl group having 8 to 16 carbon atoms.

Examples of the conjugated diene monomer include a conjugated diene having 4 to 12 carbon atoms, and specific examples thereof include 1,3-butadiene, isoprene, piperylene, 4-methylpenta-1,3-diene, 3,4-dimethyl-1,3-hexadiene, and 4,5-diethyl-1,3-octadiene.

The weight average molecular weight (Mw) of the star polymer (B1) is preferably 50,000 to 750,000, more preferably 100,000 to 700,000, and further preferably 150,000 to 650,000.

The molecular weight distribution (Mw/Mn) of the star polymer (B1) (wherein Mn represents the number average molecular weight of the star polymer (B1)) is preferably 8.0 or less, more preferably 5.0 or less, further preferably 3.0 or less, and still further preferably 1.9 or less, and is generally 1.01 or more.

In the description herein, the weight average molecular weight (Mw) and the number average molecular weight (Mn) are standard polystyrene-conversion values measured by gel permeation chromatography (GPC), and specifically mean values that are measured by the method described in the examples.

In the lubricating oil composition of one embodiment of the present invention, the content of the star polymer (B1) in terms of resin component is preferably 0.01 to 10% by mass, more preferably 0.05 to 5.0% by mass, further preferably 0.10 to 2.0% by mass, and still further preferably 0.20 to 1.0% by mass, based on the total amount (100% by mass) of the lubricating oil composition.

[Comb Polymer (B2)]

It suffices that the comb polymer (B2) is a polymer that has a structure having a large number of trifurcation points, from each of which a high-molecular weight side chain is started, on the main chain.

The comb polymer (B2) used in one embodiment of the present invention is preferably a polymer that has at least a constitutional unit (X1) derived from a macromonomer (x1). The constitutional unit (X1) corresponds to the aforementioned "high-molecular weight side chain".

In the present invention, the "macromonomer (x1)" means a high-molecular weight monomer having a polymerizable functional group, and is preferably a high-molecular weight monomer having a polymerizable functional group at an end thereof.

The number average molecular weight (Mn) of the macromonomer (x1) is preferably 300 or more, more preferably 400 or more, and further preferably 500 or more, and is preferably 100,000 or less, more preferably 50,000 or less, and further preferably 20,000 or less.

The comb polymer (B2) used in one embodiment of the present invention may be a homopolymer formed only of the constitutional unit (X1) derived from one kind of the macromonomer (x1), and may be a copolymer containing the constitutional units (X1) derived from two or more kinds of the macromonomers (x1).

The comb polymer (B2) used in one embodiment of the present invention may be a copolymer containing a constitutional unit (X2) derived from a monomer (x2) other than the macromonomer (x1), in addition to the constitutional unit derived from the macromonomer (x1).

The specific structure of the comb polymer is preferably a copolymer having a main chain containing the constitutional unit (X2) derived from the monomer (x2) and side chains containing the constitutional unit (X1) derived from the macromonomer (x1).

Examples of the monomer (x2) include an alkyl (meth) acrylate, a nitrogen atom-containing vinyl monomer, a hydroxy group-containing vinyl monomer, a phosphorus atom-containing monomer, an aliphatic hydrocarbon-based vinyl monomer, an alicyclic hydrocarbon-based vinyl monomer, a vinyl ester compound, a vinyl ether compound, a vinyl ketone compound, an epoxy group-containing vinyl monomer, a halogen element-containing vinyl monomer, an unsaturated carboxylate ester, a (di)alkyl fumarate, a (di) alkyl maleate, and an aromatic hydrocarbon-based vinyl monomer.

The mass average molecular weight (Mw) of the comb polymer (B2) is preferably 100,000 to 1,000,000, more preferably 200,000 to 800,000, further preferably 250,000 to 750,000, and still further preferably 300,000 to 700,000.

The molecular weight distribution (Mw/Mn) of the comb polymer (B2) (wherein Mn represents the number average molecular weight of the comb polymer (B2)) is preferably 8.00 or less, more preferably 7.00 or less, further preferably 6.00 or less, and still further preferably 3.00 or less, and is generally 1.01 or more, preferably 1.05 or more, and more preferably 1.10 or more.

In the lubricating oil composition of one embodiment of the present invention, the content of the comb polymer (B2) in terms of resin component is preferably 0.01 to 10% by mass, more preferably 0.05 to 5.0% by mass, further preferably 0.10 to 2.0% by mass, and still further preferably 0.20 to 1.0% by mass, based on the total amount (100% by mass) of the lubricating oil composition.

[Polymethacrylate (B3)]

In one embodiment of the present invention, the viscosity index improver (B) preferably contains the star polymer (B1) and a polymethacrylate (B3).

It has been found that the use of the viscosity index improver (B) containing the star polymer (B1) and the polymethacrylate (B3) can further enhance the retention of the effect of suppressing the formation of deposits that may occur inside the compressor, and simultaneously can provide a lubricating oil composition capable of further enhancing the fuel efficiency capability.

From the aforementioned standpoint, the viscosity index improver (B) used in one embodiment of the present invention preferably contains the star polymer (B1) having an SSI of 1 to 12 and the polymethacrylate (B3) having an SSI of 20 to 30.

In general, a polymer having a high SSI tends to decompose by shear, and thus has been considered to be a factor of the deposit formation. However, according to the investigations by the present inventors, it has been found that the combination use of the polymethacrylate (B3) having a relatively high SSI with the star polymer (B1) having a relatively low SSI can further enhance the retention of the effect of suppressing the formation of deposits that may occur inside the compressor, as compared to the case where the star polymer (B1) is used alone.

Even in this case where the polymers different in SSI from each other are used in combination as a mixture, the content ratios of the polymers are controlled to make the SSI of the viscosity index improver (B), i.e., the mixture, within the aforementioned range as described above.

In the case where the viscosity index improver (B) used in one embodiment of the present invention contains the star polymer (B1) and the polymethacrylate (B3), the content ratio ((B1)/(B3)) in terms of resin component of the star polymer (B1) and the polymethacrylate (B3) in terms of mass ratio is preferably 0.07 to 0.20, more preferably 0.08 to 0.17, and further preferably 0.085 to 0.14, from the aforementioned standpoint.

The polymethacrylate (B3) may be either a non-dispersion type polymethacrylate or a dispersion type polymethacrylate.

Examples of the non-dispersion type polymethacrylate include a polymer having a constitutional unit derived from an alkyl methacrylate having an alkyl group having 1 to 20 carbon atoms. The polymer may be a copolymer further having a constitutional unit derived from a monomer having a functional group, such as a hydroxy group and a carboxy group.

Examples of the dispersion type polymethacrylate include a copolymer of a methacrylate and a nitrogen-containing monomer having an ethylenic unsaturated bond.

Examples of the nitrogen-containing monomer include dimethylaminomethyl methacrylate, diethylaminomethyl methacrylate, dimethylaminoethyl methacrylate, diethylaminoethyl methacrylate, 2-methyl-5-vinylpyridine, morpholinomethyl methacrylate, morpholino ethyl methacrylate, N-vinylpyrrolidone, and mixtures thereof.

The weight average molecular weight (Mw) of the polymethacrylate (B3) is preferably 50,000 to 700,000, more preferably 100,000 to 600,000, further preferably 150,000 to 550,000, still further preferably 200,000 to 500,000, and particularly preferably 250,000 to 450,000.

The molecular weight distribution (Mw/Mn) of the polymethacrylate (B3) (wherein Mn represents the number average molecular weight) is preferably 4.0 or less, more preferably 3.7 or less, and further preferably 3.5 or less, and is generally 1.01 or more.

The content of the polymethacrylate (B3) in terms of resin component is preferably 0.01 to 10% by mass, more preferably 0.05 to 7.0% by mass, and further preferably 0.10 to 5.0% by mass, based on the total amount of the lubricating oil composition.

[Additional Viscosity Index Improver]

The viscosity index improver (B) used in one embodiment of the present invention may contain an additional polymer other than the components (B1) to (B3) described above to the extent that the SSI can be controlled to the aforementioned range and the effects of the present invention is not impaired.

Examples of the additional polymer include an olefin-based copolymer (such as an ethylene-propylene copolymer) and a styrene-based copolymer (such as a styrene-diene copolymer and a styrene-isoprene copolymer).

In the viscosity index improver (B) used in one embodiment of the present invention, however, the contents of the olefin-based copolymer and the styrene-based copolymer that do not correspond to the components (B1) to (B3) are preferably as small as possible.

Specifically, the contents of the olefin-based copolymer and the styrene-based copolymer in terms of resin component each independently are preferably less than 1.0% by mass, more preferably less than 0.1% by mass, and further preferably less than 0.01% by mass, based on the total resin amount (100% by mass) of the viscosity index improver (B).

<Additives for Lubricating Oil Composition>

The lubricating oil composition of one embodiment of the present invention may further contain additives for a lubricating oil composition that are generally used, depending on necessity in such a range that does not impair the effects of the present invention.

Examples of the additives for a lubricating oil composition include a metal-based detergent, an ash-free dispersant, an anti-wear agent, an extreme pressure agent, an antioxidant, an anti-foaming agent, a friction modifier, a rust inhibitor, and a metal deactivator.

The additives for a lubricating oil composition used may be a commercially available additive package including plural additives adapting to the regulations by European Automobile Manufacturers' Association (ACEA) and the API, ILSAC SN, and GF-5 regulations.

A compound that has functions of the plural additives (such as a compound having functions of an anti-wear agent and an extreme pressure agent) may also be used.

The additives for a lubricating oil composition may be used alone or as a combination of two or more kinds thereof.

The contents of the additives for a lubricating oil composition may be appropriately controlled to the extent that do not impair the effects of the present invention, and each are generally 0.001 to 15% by mass, preferably 0.005 to 10% by mass, and more preferably 0.01 to 8% by mass, based on the total amount (100% by mass) of the lubricating oil composition.

In the lubricating oil composition of one embodiment of the present invention, the total content of the additives for a lubricating oil composition is preferably 0 to 30% by mass, more preferably 0 to 25% by mass, further preferably 0 to 20% by mass, and still further preferably 0 to 15% by mass, based on the total amount (100% by mass) of the lubricating oil composition.

(Metal-Based Detergent)

Examples of the metal-based detergent include an organic acid metal salt compound containing a metal atom selected from an alkali metal and an alkaline earth metal, and specific examples thereof include a metal salicylate, a meal phenate, and a metal sulfonate each containing a metal atom selected from an alkali metal and an alkaline earth metal.

In the description herein, the "alkali metal" means lithium, sodium, potassium, rubidium, cesium, and francium.

The "alkaline earth metal" means beryllium, magnesium, calcium, strontium, and barium.

The metal atom contained in the metal-based detergent is preferably sodium, calcium, magnesium, or barium, and more preferably calcium, from the standpoint of the enhancement of the detergency at a high temperature.

The metal salicylate is preferably a compound represented by the following general formula (1), the metal phenate is preferably a compound represented by the following general formula (2), and the metal sulfonate is preferably a compound represented by the following general formula (3).

(1)

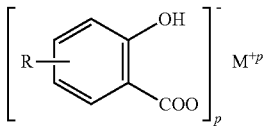

(2)

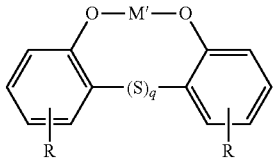

(3)

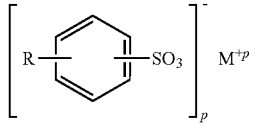

In the general formulae (1) to (3), M represents a metal atom selected from an alkali metal and an alkaline earth metal, preferably sodium, calcium, magnesium, or barium, and more preferably calcium; M' represents an alkaline earth metal, preferably calcium, magnesium, or barium, and more preferably calcium; p represents a valence number of M, which is 1 or 2; R represents a hydrogen atom or a hydrocarbon group having 1 to 18 carbon atoms; and q represents an integer of 0 or more, and preferably an integer of 0 to 3.

Examples of the hydrocarbon group capable of being selected as R include an alkyl group having 1 to 18 carbon atoms, an alkenyl group having 1 to 18 carbon atoms, a cycloalkyl group having 3 to 18 ring carbon atoms, an aryl group having 6 to 18 ring carbon atoms, an alkylaryl group having 7 to 18 carbon atoms, and an arylalkyl group having 7 to 18 carbon atoms.

In one embodiment of the present invention, the metal-based detergent may be used alone or as a combination of two or more kinds thereof.

Among these, one or more kinds selected from calcium salicylate, calcium phenate, and calcium sulfonate are preferred from the standpoint of the enhancement of the detergency at a high temperature and the standpoint of the solubility in the base oil.

In one embodiment of the present invention, the metal-based detergent may be any of a neutral salt, a basic salt, an overbased salt, and mixtures thereof.

The total base number of the metal-based detergent is preferably 0 to 600 mgKOH/g.

In one embodiment of the present invention, in the case where the metal-based detergent is a basic salt or an overbased salt, the total base number of the metal-based detergent is preferably 10 to 600 mgKOH/g, and more preferably 20 to 500 mgKOH/g.

In the description herein, the "base number" means a base number by the perchloric acid method that is measured according to JIS K2501, Section 7 of "Petroleum Products and Lubricants-Determination of Neutralization Number".

(Ash-Free Dispersant)

Examples of the ash-free dispersant include succinimide, benzylamine, a succinate ester, and boron-modified products thereof, and an alkenylsuccinimide and a boron-modified alkenylsuccinimide are preferred.

Examples of the alkenylsuccinimide include an alkenyl succinic acid monoimide represented by the following general formula (i) and an alkenyl succinic bisimide represented by the following general formula (ii).

The alkenylsuccinimide may be a modified alkenylsuccinimide that is obtained through reaction of the compound represented by the following general formula (i) or (ii) with one or more kinds selected from an alcohol, an aldehyde, a ketone, an alkylphenol, a cyclic carbonate, an epoxy compound, an organic acid, and the like.

Examples of the boron-modified alkenylsuccinimide include a boron-modified product of the compound represented by the following general formula (i) or (ii).

(i)

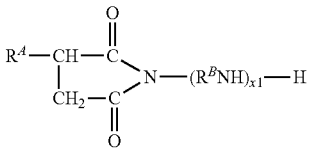

-continued (ii)

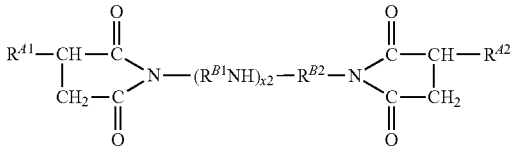

In the general formulae (i) and (ii), $R^A$, $R^{A1}$, and $R^{A2}$ each independently represent an alkenyl group having a mass average molecular weight (Mw) of 500 to 3,000 (preferably 1,000 to 3,000), and preferably a polybutenyl group or a polyisobutenyl group.

$R^B$, $R^{B1}$, and $R^{B2}$ each independently represent an alkylene group having 2 to 5 carbon atoms.

x1 represents an integer of 1 to 10, preferably an integer of 2 to 5, and more preferably 3 or 4.

x2 represents an integer of 0 to 10, preferably an integer of 1 to 4, and more preferably 2 or 3.

In one embodiment of the present invention, the ratio (B/N) of boron atoms and nitrogen atoms constituting the boron-modified alkenylsuccinimide is preferably 0.5 or more, more preferably 0.6 or more, further preferably 0.8 or more, and still further preferably 0.9 or more, from the standpoint of the enhancement of the detergency.

(Anti-Wear Agent)

Examples of the anti-wear agent include a sulfur-containing compound, such as a zinc dialkyldithiophosphate (ZnDTP), zinc phosphate, zinc dithiocarbamate, molybdenum dithiocarbamate, molybdenum dithiophosphate, a disulfide compound, a sulfurized olefin compound, sulfurized fat and oil, a sulfurized ester compound, a thiocarbonate compound, a thiocarbamate compound, and a polysulfide compound; a phosphorus-containing compound, such as a phosphite ester compound, a phosphate ester compound, a phosphonate ester compound, and amine salts and metal salts thereof; and a sulfur and phosphorus-containing anti-wear agent, such as thiophosphite ester compound, a thiophosphate ester compound, a thiophosphonate ester compound, and amine salts and metal salts thereof.

Among these, a zinc dialkyklithiophosphate (ZnDTP) is preferred, and the combination use of a primary alkyl type zinc dialkyldithiophosphate and a secondary alkyl type zinc dialkyklithiophosphate is more preferred.

(Extreme Pressure Agent)

Examples of the extreme pressure agent include a sulfur-based extreme pressure agent, such as a sulfide compound, a sulfoxide compound, a sulfone compound, and a thiophosphinate compound, a halogen-based extreme pressure agent, such as a chlorinated hydrocarbon, and an organic metal-based extreme pressure agent. A compound that has a function of an extreme pressure agent among the anti-wear agents described above may also be used.

In one embodiment of the present invention, the extreme pressure agent may be used alone or as a combination of two or more kinds thereof.

(Antioxidant)

The antioxidant used may be an arbitrary one appropriately selected from the known antioxidants having been used as an antioxidant for a lubricating oil, and examples thereof include an amine-based antioxidant, a phenol-based antioxidant, a molybdenum-based antioxidant, a sulfur-based antioxidant, and a phosphorus-based antioxidant.

Examples of the amine-based antioxidant include a diphenylamine-based antioxidant, such as diphenylamine and an alkylated diphenylamine having an alkyl group having 3 to 20 carbon atoms; and a naphthylamine-based antioxidant, such as α-naphthylamine, phenyl-α-naphthylamine, and a substituted phenyl-α-naphthylamine having an alkyl group having 3 to 20 carbon atoms.

Examples of the phenol-based antioxidant include a monophenol-based antioxidant, such as 2,6-di-tert-butylphenol, 2,6-di-tert-butyl-4-methylphenol, 2,6-di-tert-butyl-4-ethylphenol, isooctyl-3-(3,5-di-tert-butyl-4-hydroxyphenyl) propionate, and octadecyl-3-(3,5-di-tert-butyl-4-hydroxyphenyl) propionate; a diphenol-based antioxidant, such as 4,4'-methylenebis(2,6-di-tert-butylphenol) and 2,2'-methylenebis(4-ethyl-6-tert-butylphenol); and a hindered phenol-based antioxidant.

Examples of the molybdenum-based antioxidant include a molybdenum amine complex obtained through reaction of molybdenum trioxide and/or molybdic acid and an amine compound.

Examples of the sulfur-based antioxidant include dilauryl 3,3'-thiodipropionate

Examples of the phosphorus-based antioxidant include a phosphite.

In one embodiment of the present invention, the antioxidant may be used alone or as a combination of two or more kinds thereof, and is preferably used as a combination of two or more kinds thereof.

(Anti-Foaming Agent)

Examples of the anti-foaming agent include a silicone oil, a fluorosilicone oil, and a fluoroalkyl ether.

(Friction Modifier)

Examples of the friction modifier include a molybdenum-based friction modifier, such as molybdenum dithiocarbamate (MoDTC), molybdenum dithiophosphate (MoDTP), and an amine salt of molybdic acid; an ash-free friction modifier, such as an aliphatic amine, a fatty acid ester, a fatty acid amide, a fatty acid, an aliphatic alcohol, and an aliphatic ether each having at least one alkyl group or alkenyl group having 6 to 30 carbon atoms in the molecule; oil and fat, an amine, an amide, a sulfurized ester, a phosphate ester, a phosphite ester, and a phosphate ester amine salt.

(Rust Inhibitor)

Examples of the rust inhibitor include a fatty acid, an alkenyl succinic acid half ester, a fatty acid soap, an alkyl sulfonate salt, a polyhydric alcohol fatty acid ester, a fatty acid amine, an oxidized paraffin, and an alkyl polyoxyethylene ether.

(Metal Deactivator)

Examples of the metal deactivator include a benzotriazole-based compound, a tolyltriazole-based compound, a thiadiazole-based compound, an imidazole-based compound, and a pyrimidine-based compound.

[Properties of Lubricating Oil Composition]

The kinematic viscosity at 100° C. of the lubricating oil composition of one embodiment of the present invention is preferably 5.6 to 12.5 $mm^2/s$, more preferably 6.0 to 11.0 $mm^2/s$, further preferably 6.3 to 10.0 $mm^2/s$, still further preferably 6.6 to 10.5 $mm^2/s$, and particularly preferably 6.8 to 10.3 $mm^2/s$.

The viscosity index of the lubricating oil composition of one embodiment of the present invention is preferably 110 or more, more preferably 120 or more, further preferably 140 or more, and still further preferably 160 or more.

In the description herein, the kinematic viscosity and the viscosity index mean values that are measured according to JIS K2283:2000.

The HTHS viscosity at 100° C. ($T_{100}$) of the lubricating oil composition of one embodiment of the present invention is preferably 4.0 to 6.3 mPa·s, more preferably 4.2 to 6.3 mPa·s, further preferably 4.3 to 5.8 mPa·s, and still further preferably 4.5 to 5.7 mPa·s.

The HTHS viscosity at 150° C. ($T_{150}$) of the lubricating oil composition of one embodiment of the present invention is preferably 2.6 to 4.0 mPa·s, more preferably 2.6 to 3.6 mPa·s, and further preferably 2.6 to 3.3 mPa·s.

The ratio ($T_{150}/T_{100}$) of the HTHS viscosity at 150° C. ($T_{150}$) and the HTHS viscosity at 100° C. ($T_{100}$) of the lubricating oil composition of one embodiment of the present invention is preferably 0.40 or more, more preferably 0.43 or more, further preferably 0.45 or more, and still further preferably 0.50 or more.

In the description herein, the HTHS viscosity (high-temperature high-shear viscosity) means a value of viscosity after shearing at a shear rate of $10^6$ per second according to ASTM D4741.

The content of nitrogen atoms in the lubricating oil composition of one embodiment of the present invention is preferably 0.01 to 0.25% by mass, more preferably 0.03 to 0.20% by mass, and further preferably 0.05 to 0.18% by mass, based on the total amount (100% by mass) of the lubricating oil composition.

In the description herein, the content of nitrogen atoms means a value that is measured according to JIS K2609:1998.

The content of calcium atoms in the lubricating oil composition of one embodiment of the present invention is preferably 0.005 to 0.20% by mass, more preferably 0.01 to 0.18% by mass, and further preferably 0.02 to 0.15% by mass, based on the total amount (100% by mass) of the lubricating oil composition.

The content of molybdenum atoms in the lubricating oil composition of one embodiment of the present invention is preferably 0.001 to 0.50% by mass, more preferably 0.005 to 0.30% by mass, and further preferably 0.010 to 0.10% by mass, based on the total amount (100% by mass) of the lubricating oil composition.

In the description herein, the contents of molybdenum atoms and calcium atoms are values that are measured according to JPI-5S-38-92.

The sulfated ash content of the lubricating oil composition of one embodiment of the present invention is preferably 0.90% by mass or less, more preferably 0.80% by mass or less, and further preferably 0.70% by mass or less, and is preferably 0.10% by mass or more, more preferably 0.15% by mass or more, and further preferably 0.20% by mass or more.

In the description herein, the sulfated ash content means a value that is measured according to JIS K2272:1998.

The NOACK value at 250° C. of the lubricating oil composition of one embodiment of the present invention is preferably 12.0% by mass or less, more preferably 10.5% by mass or less, further preferably 9.0% by mass or less, and still further preferably 8.5% by mass or less.

In the description herein, the NOACK value at 250° C. means a value that is measured according to JPI-5S-41-2004.

[Method for Using Lubricating Oil Composition]

The lubricating oil composition of the present invention has a high retention of the effect of suppressing the formation of deposits that may occur inside the compressor and is capable of retaining a high efficiency of the compressor for a long period of time, in the use thereof in a diesel engine equipped with a forced-induction compressor having an outlet temperature of the compressor becoming a high temperature reaching 190° C. or more.

Accordingly, the present invention can also provide a "method for using a lubricating oil composition, including using the lubricating oil composition in a diesel engine equipped with a forced-induction compressor having an outlet temperature of a compressor becoming 190° C. or more".

The details of the lubricating oil composition used in the using method of the present invention are as described above.

In the use of the lubricating oil composition, the outlet temperature of the compressor of the forced-induction compressor may not necessarily be 190° C. or more consistently. However, the effect of suppressing the formation of deposits that may occur inside the compressor can be highly retained even in the case where the period of time where the outlet temperature of the compressor becomes 190° C. or more is prolonged.

EXAMPLES

The present invention will be described in more detail with reference to examples below, but the present invention is not limited to the examples. The physical property values of the components used in Examples and Comparative Examples and the resulting lubricating oil compositions were measured according to the following methods.

<Kinematic Viscosity and Viscosity Index>

The values were measured and calculated according to JIS K2283:2000.

<SSI (Shear Stability Index)>

The value was measured according to ASTM D6278.

<Mass Average Molecular Weight (Mw)>

The measurement was performed with a gel permeation chromatography apparatus ("1260 Type HPLC", produced by Agilent Technologies, Inc.) under the following condition, and a value measured in terms of standard polystyrene conversion was used.

(Measurement Condition)

Column: Two columns of "Shodex LF404" connected in series

Column temperature: 35° C.

Developing solvent: chloroform

Flow rate: 0.3 mL/min

<Distillation Amount of Light Fraction of 496° C. or Less>

The value was measured by a gas chromatography distillation test according to ASTM D6352.

<HTHS Viscosity>

The viscosity after shearing at a shear rate of $10^6$ per second at the prescribed temperature was measured according to ASTM D4741.

<NOACK Value>

The value was measured at 250° C. according to JPI-5S-41-2004.

<Contents of Molybdenum Atoms and Calcium Atoms>

The values were measured according to JPI-5S-38-92.

<Content of Nitrogen Atoms>

The value was measured according to JIS K2609:1998.

<Sulfated Ash Content>

The value was measured according to JIS K2272:1998.

Examples 1 to 3 and Comparative Examples 1 to 4

The base oils and the additives shown below were added in the blending amounts shown in Table 1 and sufficiently mixed to prepare lubricating oil compositions. The blending amounts of the viscosity index improvers in Table 1 are shown as blending amounts in terms of resin component excluding the diluent solvent.

The details of the base oils and the additives used in Examples and Comparative Examples are shown below.

<Base Oil>

PAO (1): 100° C. kinematic viscosity=3.9 $mm^2/s$, viscosity index=118, poly-α-olefin, Mw=440, polymer containing unit derived from 1-decene PAO (2): 100° C. kinematic viscosity=5.1 $mm^2/s$, viscosity index=134, poly-α-olefin, Mw=510, polymer containing unit derived from 1-decene PAO (3): 100° C. kinematic viscosity=5.6 $mm^2/s$, viscosity index=137, poly-α-olefin, Mw=550, polymer containing unit derived from 1-decene Mineral oil (1): 100° C. kinematic viscosity=4.1 $mm^2/s$, viscosity index=130, mineral oil classified into Group 3 of API base oil category Ester (1): 100° C. kinematic viscosity=4.3 $mm^2/s$, viscosity index=126, polyol fatty acid ester <Viscosity Index Improver>

Star polymer (1): Star polymer having structure having three or more linear polymer chains bonded at one point, kind of branched polymer, SSI=3, Mw=450,000, Mw/Mn=1.1

Star polymer (2): Star polymer having structure having three or more linear polymer chains bonded at one point, kind of branched polymer, SSI=12, Mw=610,000, Mw/Mn=1.1

PMA (1): Polymethacrylate, SSI=20, Mw=430,000, Mw/Mn=3.5

PMA (2): Polymethacrylate, SSI=23, Mw=160,000, Mw/Mn=2.5

PMA (3): Polymethacrylate, SSI=25, Mw=220,000, Mw/Mn=2.2

PMA (4): Polymethacrylate, SSI=50, Mw=540,000, Mw/Mn=2.9

OCP (1): Olefin copolymer, SSI=49, Mw=330,000, MwfMn=1.6

<Other Additives>

Additive package: Additive package including following additives adapting to Class C of European Automobile Manufacturers' Association (ACEA)

Metal detergent: Calcium sulfonate and calcium phenate

Ash-free dispersant: Polybutenyl succinimide

Anti-wear agent: Zinc dialkyklithiophosphate (ZnDTP)

Antioxidant: Amine-based antioxidant, phenol-based antioxidant, and molybdenum-based antioxidant Anti-foaming agent: Silicone-based anti-foaming agent Friction modifier: Ester-based friction modifier, molybdenum dithiocarbamate (MoDTC)

Metal deactivator: Benzotriazole

Pour point depressant: Polymethacrylate

The lubricating oil compositions prepared in Examples and Comparative Examples were measured and calculated for the physical property values according to the measurement methods described above, and also subjected to a suppression test of deposit formation according to the following method.

The results are shown in Table 1.

<Suppression Test of Deposit Formation>

A test was performed according to the reference literature, "SAE Technical Paper 2013-01-2500, 2013 (published on Oct. 14, 2013)", with the outlet temperature of the compressor controlled to 190 to 200° C., and the period of time until the deposit formation was calculated.

Herein, the period of time until the temperature rise of the outlet temperature of the compressor became 10° C. or more from the start of the test, and the attachment of deposits was confirmed was designated as the "period of time until the deposit formation".

TABLE 1

| | | | Example 1 | Example 2 | Example 3 | Comparative Example 1 | Comparative Example 2 | Comparative Example 3 | Comparative Example 4 |
|---|---|---|---|---|---|---|---|---|---|
| Composition of lubricating oil composition | | | | | | | | | |
| Base oil | PAO (1) | % by mass | | | | 12.00 | | | |
| | PAO (2) | % by mass | 12.20 | | | | 55.40 | | |
| | PAO (3) | % by mass | 47.20 | 79.98 | 37.85 | 10.00 | | 39.35 | 37.50 |
| | Mineral oil (1) | % by mass | 20.07 | | 49.88 | 64.29 | 22.52 | 48.55 | 50.59 |
| | Ester (1) | % by mass | 5.00 | 5.00 | | | 5.00 | | |
| Viscosity index improver | Star polymer (1) SSI = 3 | % by mass | 0.32 | 0.32 | | | 0.32 | | |
| | Star polymer (2) SSI = 12 | % by mass | | | 0.67 | 0.44 | | | |
| | PMA (1) SSI = 20 | % by mass | 3.61 | 3.10 | | | 5.16 | | |
| | PMA (2) SSI = 23 | % by mass | | | | | | 0.50 | |
| | PMA (3) SSI = 25 | % by mass | | | | 1.12 | | | |
| | PMA (4) SSI = 50 | % by mass | | | | 0.55 | | | |
| | OCP (1) SSI = 49 | % by mass | | | | | | | 0.31 |
| Other additives | Additive package | % by mass | 11.60 | 11.60 | 11.60 | 11.60 | 11.60 | 11.60 | 11.60 |
| Total | | % by mass | 100.00 | 100.00 | 100.00 | 100.00 | 100.00 | 100.00 | 100.00 |
| SSI of viscosity index improver | | — | 18.6 | 18.4 | 12.0 | 28.8 | 19.0 | 23.0 | 49.0 |
| Star polymer/PMA content ratio (mass ratio) | | — | 0.089 | 0.103 | — | 0.263 | 0.062 | 0 | — |
| 100° C. kinematic viscosity of PAO | | $mm^2/s$ | 5.2 | 5.6 | 5.6 | 4.6 | 5.1 | 5.6 | 5.6 |
| Content of PAO based on total amount (100% by mass) of base oil | | % by mass | 70.3 | 94.1 | 43.1 | 25.5 | 66.8 | 44.8 | 42.6 |
| Properties of lubricating oil composition | | | | | | | | | |
| Distillation amount of light fraction of 496° C. or less | | % by volume | 71 | 60 | 78 | 88 | 80 | 80 | 77 |
| Kinematic viscosity | 40° C. | $mm^2/s$ | 49.8 | 54.4 | 45.3 | 48.5 | 48.2 | 37.8 | 43.2 |
| | 100° C. | $mm^2/s$ | 9.7 | 10.1 | 8.5 | 10.2 | 10.2 | 7.8 | 8.1 |
| Viscosity index | | — | 185 | 175 | 166 | 206 | 206 | 182 | 165 |
| HTHS viscosity | 100° C. ($T_{100}$) | mPa · s | 4.6 | 4.7 | 5.7 | 6.2 | 6.1 | 5.6 | 5.6 |
| | 150° C. ($T_{150}$) | mPa · s | 3.0 | 3.1 | 2.6 | 3.1 | 3.2 | 2.6 | 2.6 |
| | $T_{150}/T_{100}$ | — | 0.65 | 0.66 | 0.46 | 0.50 | 0.52 | 0.46 | 0.46 |
| Content of nitrogen atoms | | % by mass | 0.12 | 0.12 | 0.12 | 0.12 | 0.12 | 0.12 | 0.12 |
| Content of calcium atoms | | % by mass | 0.11 | 0.11 | 0.11 | 0.11 | 0.11 | 0.11 | 0.11 |
| Content of molybdenum atoms | | % by mass | 0.04 | 0.04 | 0.04 | 0.04 | 0.04 | 0.04 | 0.04 |
| Sulfated ash content | | % by mass | 0.60 | 0.60 | 0.60 | 0.60 | 0.60 | 0.60 | 0.60 |
| NOACK value | 250° C. | % by mass | 8.1 | 6.9 | 10.0 | 12.5 | 8.7 | 9.8 | 10.4 |
| Suppression test of deposit formation | | | | | | | | | |
| Period of time until deposit formation | | hr | 112 | 120 | 114 | 80 | 60 | 80 | 89 |

As shown in Table 1, in the use in the forced-induction compressor having an outlet temperature of the compressor becoming 190 to 200° C., the lubricating oil compositions prepared in Examples 1 to 3 each resulted in a long period of time until the deposit formation as compared to those in Comparative Examples 1 to 4.

Accordingly, it can be said that the lubricating oil compositions prepared in Examples 1 to 3 have a high retention of the effect of suppressing the formation of deposits that may occur inside the compressor and are capable of retaining the high efficiency of the compressor for a long period of time.

The invention claimed is:

1. A lubricating oil composition suitable for use in a diesel engine equipped with a forced-induction compressor, the composition comprising:

a base oil (A) comprising, a poly-α-olefin (A1); and a viscosity index improver (B) having a shear stability index of 20 or less, the viscosity index improver (B) comprising a star polymer (B1) and a polymethacrylate (B3), and wherein the composition has a distillation amount of a light fraction of 496° C. or less in a gas chromatography distillation test of less than 80% by volume, and wherein the composition has a (B1)/(B3) mass content ratio in terms of resin component of the star polymer (B1) and the polymethacrylate (B3) in a range of from 0.07 to 0.20.

2. The composition of claim 1, wherein the viscosity index improver (B) further comprises a comb polymer (B2).

3. The composition of claim 2, wherein the star polymer (B1) and the comb polymer (B2), in terms of resin component, are each independently present in a range of from 0.01 to 10% by mass, based on a total lubricating oil composition mass.

4. The composition of claim 1, wherein the polymethacrylate (B3) has an SSI in a range of from 20 to 30.

5. The composition of claim 1, wherein the polymethacrylate (B3) comprises a copolymer of a methacrylate and a nitrogen-comprising monomer havine an ethylenic unsaturated bond.

6. The composition according of claim 4, having a (B1)/(B3) mass content ratio in terms of resin component of the star polymer (B1) and the polymethacrylate (B3) in a range of from 0.08 to 0.17.

7. The composition of claim 1, wherein the poly-α-olefin (A1) has a kinematic viscosity at 100° C. of 5.0 $mm^2/s$ or more.

8. The composition according toof claim 1, wherein the base oil (A) further comprises a mineral oil (A2).

9. The composition of claim 1, wherein the poly-α-olefin (A1) is present in a range of from 30% by mass or more, based on total base oil (A) mass.

10. The composition of claim 1, having a kinematic viscosity at 100° C. in a range of from 5.6 to 12.5 $mm^2/s$.

11. The composition of claim 1, having a HTHS viscosity at 100° C. in a range of from 4.0 to 6.3 mPa·s.

12. A method for using a lubricating oil composition, comprising using the lubricating oil composition of claim 1 in a diesel engine equipped with a forced-induction compressor having an outlet temperature of a compressor in operation of 190° C. or more.

13. The composition of claim 1, wherein the star polymer (B1), in terms of resin component, is in range of from 0.01 to 10%, by mass, based on a total lubricating oil composition mass.

14. The composition of claim 1, wherein the polymethacrylate (B3) has a weight-average molecular weight in a range of from 150,000 to 550,000.

15. The composition of claim 1, wherein the polymethacrylate (B3) is present in a range of from 0.01 to 5% by mass in terms of resin component, based on the total lubricating oil composition mass.

16. The composition of claim 1, wherein the star polymer (B1) has a weight average molecular weight in a range of from 50,000 to 750,000.

17. The composition of claim 1, having a (B1)/(B3) mass content ratio in terms of resin component of the star polymer (B1) and the polymethacrylate (B3) in a range of from 0.08 to 0.14.

18. The composition of claim 1, wherein the star polymer (B1) has a molecular weight distribution of no more than 1.9.

19. The composition of claim 1, wherein the star polymer (B1) is present in an range of from 0.1 to 2.0% by mass, based on the total lubricating oil composition mass.

20. The composition of claim 1, comprising no more than 0.04% by mass of molybdenum atoms, based on the total lubricating oil composition mass.

* * * * *